United States Patent [19]

Klygis et al.

[11] Patent Number: 4,974,726

[45] Date of Patent: Dec. 4, 1990

[54] CLIP-ON SHEET FOR BEVERAGE CANS AND PACKAGE USING SAME

[75] Inventors: Mindaugas J. Klygis, Barrington; Leslie S. Marco, Bloomingdale, both of Ill.

[73] Assignee: Illinois Tool Works, Inc., Glenview, Ill.

[21] Appl. No.: 519,857

[22] Filed: May 7, 1990

[51] Int. Cl.[5] ..... B65D 75/00

[52] U.S. Cl. ..... 206/158; 206/150; 206/151; 206/199; 206/427; 294/87.2

[58] Field of Search ..... 206/139, 145–147, 206/149–156, 158, 159, 161, 199, 427, 431; 294/87.2, 159

[56] References Cited

U.S. PATENT DOCUMENTS

| | | | |
|---|---|---|---|
| 1,679,968 | 8/1928 | Gatchell . | |
| 2,965,410 | 12/1960 | Hughes . | |
| 3,022,888 | 2/1962 | Brunsing | 206/159 |
| 3,044,230 | 7/1962 | Fisher | 294/87.2 |
| 3,094,210 | 6/1963 | Van Den Berg . | |
| 3,245,711 | 4/1966 | Dantoin . | |
| 3,302,784 | 2/1967 | Copping | 206/153 |
| 3,311,402 | 3/1967 | Spandock . | |
| 3,385,626 | 5/1968 | Wozniak | 206/150 X |
| 3,587,846 | 6/1971 | Heier | 206/151 |
| 3,627,121 | 12/1971 | Deasy | 294/87.2 X |
| 3,627,123 | 12/1971 | Wachter | 206/150 |
| 3,638,990 | 2/1972 | Huault . | |
| 3,653,504 | 4/1972 | Saumslegle . | |
| 3,966,044 | 6/1976 | Cunningham | 206/427 |
| 4,190,149 | 2/1980 | Oliff et al. . | |
| 4,301,918 | 11/1981 | Olsen | 206/150 |
| 4,305,499 | 12/1981 | Mercer | 206/150 |
| 4,588,079 | 5/1986 | Bader . | |
| 4,603,809 | 8/1986 | Vilotte et al. . | |
| 4,848,565 | 7/1989 | Klygis | 206/150 |

*Primary Examiner*—Bryon P. Gehman

*Attorney, Agent, or Firm*—Dressler, Goldsmith, Shore, Sutker & Milnamow, Ltd.

[57] ABSTRACT

A generally planar paperboard or polymeric sheet for stabilizing a rectangular array of substantially identical cans of a type having an openable end with a chime and for covering substantial portions of the openable ends of the arrayed cans. Pairs of parallel slits in the sheet define can-stabilizing strips. The sheet is clippable onto the cans in such manner that portions of the chimes extend into the paired slits and that each strip fits, without folding such strip, under portions of two adjacent cans. A package for merchandising such cans can be readily assembled by steps that include providing such cans in a rectangular array and clipping the sheet onto the cans in the specified manner.

9 Claims, 1 Drawing Sheet

CLIP-ON SHEET FOR BEVERAGE CANS AND PACKAGE USING SAME

TECHNICAL FIELD OF THE INVENTION

This invention pertains to a generally planar clip-on sheet for stabilizing a rectangular array of substantially identical cans of a type having an openable end with a chime. The sheet covers substantial portions of the openable ends of the cans. This invention pertains also to a merchandising package using such a sheet.

BACKGROUND OF THE INVENTION

In merchandising canned beverages, it is conventional to package multiple cans in a rectangular array, which may contain four, six, twelve, or twenty-four cans. Commonly, the cans are provided with a carrier gripping the individual cans and providing a handle or finger holes to facilitate carrying the gripped cans. Carriers made from thin sheets of resilient, flexible polymeric material, such as low density polyethylene, are used in countless numbers.

Typically, a beverage can has a flange-like chime at each end regarded as openable. A beverage can of an older style is made with two chimes and two openable ends. A beverage can of a newer style is made with one chime, at one openable end, which has a pull-tab or similar opening feature.

Commonly, and particularly when carriers made from thin sheets of polymeric material are used, such cans are shelved for retail sale in locations where dust or debris can collect on their openable ends. Therefore, for aesthetic and sanitary reasons, there has been a need for an inexpensive, effective way to prevent dust or debris from falling onto the openable ends of such cans.

Typically, such a carrier is applied in such manner that the carrier grips the cans at their side walls where their side walls meet their chimes, thereby to form a package. Typically, the carrier is formed with finger apertures that facilitate carrying the package with the cans in a generally upright orientation, in which the cans tend to be generally perpendicular to the carrier. Thus, when the package is carried, upward stretching forces on the carrier tend somewhat to stabilize the package.

Moreover, it has been proposed to provide such a carrier with an external handle and to apply the carrier in such a manner that the carrier grips the cans at their side walls away from their chimes, thereby to form a package. When the package is carried by such a handle, the package tends to be more floppy, as compared to a package formed typically and carried with the cans in a generally upright orientation.

This invention addresses the need for a way to prevent dust or debris from falling onto the openable ends of such cans, particularly but not exclusively when a carrier gripping such cans at their side walls away from their chimes is used.

SUMMARY OF THE INVENTION

This invention addresses both needs by providing a generally planar sheet for stabilizing a rectangular array of substantially identical cans of a type having an openable end with a chime and for covering substantial portions of the openable ends of the cans.

The sheet may be advantageously used with beverage cans of either style noted above. Its utility, however, is not limited to such cans.

The sheet has several characteristic features. Thus, the sheet has multiple pairs of substantially parallel slits. The pairs of slits are arrayed in longitudinal rows and transverse ranks. Also, as a unique feature of this invention, the sheet has can-stabilizing strips disposed respectively between the pairs of slits in each rank. The strips are defined respectively by slits in two adjacent rows.

The sheet is configured to be clippable onto the cans in the rectangular array. When the sheet has been clipped onto the cans, portions of the chimes of the respective cans extend into the slits of the respective pairs. Each strip fits, without folding such strip, under portions of the chimes of two adjacent cans in the same rank. Preferably, each strip has side edges adapted to abut the adjacent cans directly beneath the chimes of the adjacent cans when the sheet is clipped onto the cans.

Because each can-stabilizing strip fits thereunder without folding, these strips perform an important function by stabilizing the cans at their openable ends. Moreover, portions of the sheet between the slits of the respective pairs cover substantial portions of the openable ends of the respective cans.

This invention also contemplates that a package for merchandising such cans may be readily assembled by providing such cans in a rectangular array, in which their openable ends face in a common direction, and stabilizing the cans and covering substantial portions of their openable ends by means of a generally planar sheet as described above. The pairs of slits of the sheet should be arrayed, substantially as the cans are arrayed, in longitudinal rows and transverse ranks.

In assembling the package, the sheet is clipped onto the cans in the rectangular array. As mentioned above, portions of the chimes of the respective cans extend into the slits of the respective pairs and each strip fits, without folding such strip, under portions of the chimes of two adjacent cans in the same rank. Preferably, side edges of each strip abut the adjacent cans directly beneath the chimes of the adjacent cans when the sheet is clipped onto the cans.

Furthermore, the package may comprise a carrier including means for gripping the cans in such manner that the carrier does not interfere with the sheet. Thus, as an example, the carrier may be a carrier that grips the cans at their side walls away from their chimes.

These and other objects, features, and advantages of this invention will be evident from the following description of a preferred embodiment of this invention with reference to the accompanying drawing.

DETAILED DESCRIPTION OF PREFERRED EMBODIMENTS

Figures 1, 2, 3:
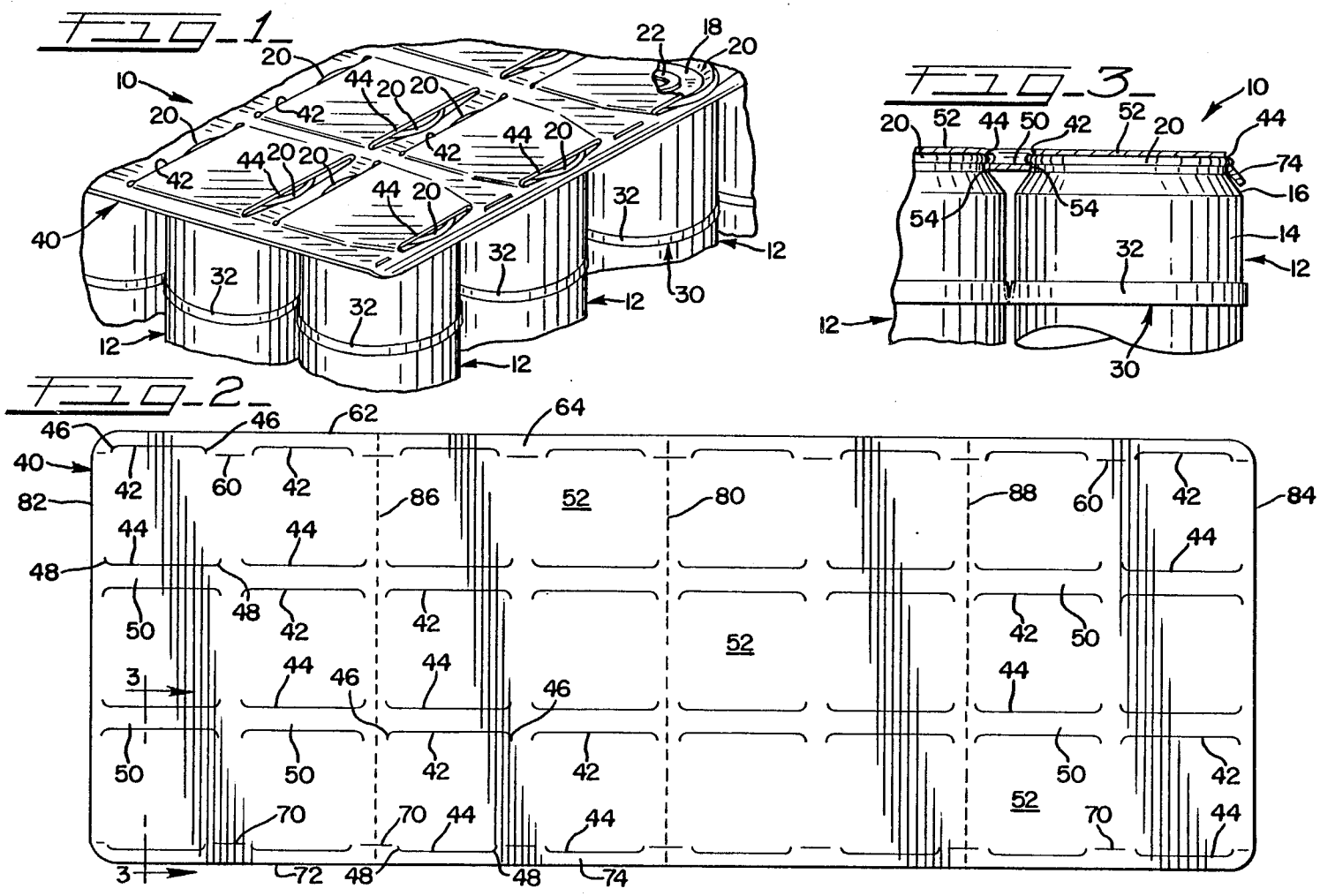
FIG. 1 is a fragmentary, perspective view of a merchandising package according to this invention and comprising a rectangular array of substantially identical cans, a generally planar sheet according to this invention, and a carrier gripping the individual cans at their side walls.
FIG. 2 is a plan view of the sheet before it has been clipped onto the cans to assemble the package shown in FIG. 1.
FIG. 3 is an enlarged, fragmentary, cross-sectional view taken along line 3—3 of FIG. 2, in a direction indicated by arrows, to show the sheet after it has been clipped onto the cans.

As shown in the drawing, a package 10 for merchandising substantially identical cans 12 of the newer style noted above constitutes a preferred embodiment of this invention.

Each can 12 has a cylindrical side wall 14, which includes a frusto-conical shoulder 16. Also, each can 12 has an openable end lB with a flange-like chime 20, which is formed where the end 18 is joined to the shoulder 16. A pull-tab 22 is mounted operatively to the openable end 18.

The package 10 comprises a rectangular array of twenty-four such cans 12 in longitudinal rows and transverse ranks (columns) with the openable ends 18 facing in a common direction. The openable ends 18 are shown as facing upwardly.

Also, the package 10 comprises a carrier 30, which comprises bands 32 gripping the individual cans 12 at their side walls 14, below their shoulders 16, and away from their chimes 20. The carrier 30 is made from a thin sheet of resilient, flexible polymeric material, such as low density polyethylene. The carrier 30 may be a known carrier, such as the carrier disclosed in Klygis U.S. Pat. No. 4,018,331 or the carrier disclosed in or Weaver et al. U.S. Pat. No. 4,219,117.

Preferably, the carrier 30 is made from carrier stock disclosed in co-pending application filed simultaneously herewith, by Robert Olsen under Ser. No. 07,519,917 and assigned commonly herewith, for "Carrier Stock For Side Wall Application." Preferably, the carrier stock is applied by a machine disclosed in a co-pending application filed simultaneously herewith, by Lonnie Ray Seymour and Kevin Dewain Moore, under Ser. No. 07,519,860 and assigned commonly herewith, for "Apparatus and Method for Applying Multi-Package Device."

Moreover, the package 10 comprises a generally planar paperboard or polymeric sheet 40 according to this invention. Paperboard, more particularly point board, is a preferred material for the sheet 40. A filled or unfilled polymeric material, such as low density polyethylene, is an alternative material for the sheet 40.

The sheet 40, which may be die-cut, is rectangular, except for rounded corners. The sheet 40 has several characteristic features, as described below.

Thus, the sheet 40 has twenty-four pairs of substantially parallel slits 42, 44. The pairs of slits 42, 44, are arrayed, substantially as the cans 12 are arrayed, in longitudinal rows and transverse ranks. Each of the slits 42, 44, is substantially straight except for its opposite ends, which are curved. In each pair of slits 42, 44, the curved ends 46 of the slit 42 and the curved ends 48 of the slit 44 point toward one another, as shown in FIG. 2.

Also, the sheet 40 has sixteen elongate, can-stabilizing strips 50. The strips 50 are disposed respectively between the pairs of slits 42, 44, in each rank and are defined respectively by slits in two adjacent rows. Each strip 50 is defined, more particularly, by one of the slits 42 and one of the slits 44.

Moreover, the sheet 40 has two folding lines near its longitudinal edges. The folding lines are defined respectively by longitudinal rows of slits.

One folding line is defined by a longitudinal row of slits 60 aligned approximately with the ends 46 of the slits 42 nearest to one longitudinal edge 62 of the sheet 40. The folding line defined by the slits 60 and the edge 62 define one longitudinal edge portion 64 of the sheet 40.

The other folding line is defined by a longitudinal row of slits 70 aligned approximately with the ends 48 of the slits 44 nearest to the other longitudinal edge 72 of the sheet 40. The folding line defined by the slits 70 and the edge 72 define another longitudinal edge portion 74 of the sheet 40.

Furthermore, the sheet 40 may have three breakaway lines defined respectively by transverse rows of perforations, if a series of selectively separable six-packs are desired. One such row of perforations 80 is located approximately half-way between the transverse edges 82, 84, of the sheet 40. Another such row of perforations 86 is located approximately half-way between the row of perforations 80 and the edge 82. The remaining row of perforations 88 is located approximately half-way between the perforations 80 and the edge 84. Other configurations of perforations may be utilized, depending on desirability to break the package into sub-groups.

The sheet 40 is configured to enable it to be readily clipped onto the cans 12 in the rectangular array in a manner shown in FIGS. 1 and 3. Specifically, the sheet 40 is clippable onto the cans 12 in such manner that portions of the chimes 20 of the respective cans 12 extend into the slits 42, 44, of the respective pairs, that each strip 50 fits, without folding such strip 50, under portions of the chimes 20 of two adjacent cans 12 in the same rank, and that planar portions 52 of the sheet 40 between the slits 42, 44, of the respective pairs cover substantial portions of the openable ends 18 of the respective cans 12.

As shown in FIG. 3, side edges 54 of each strip 50 abuts the adjacent cans 12 directly beneath the chimes 20 of the respective cans 12, thereby to lend stability to the package 10. Since the carrier 30 is resilient, the strips 50 tend to stress the package 10 from inside the package 10. Moreover, the strips 50 resist lateral movement of top portions of the cans 12 toward one another. Effectively, by combining these functions of stressing the package 10 and resisting lateral movement of top portions of the cans 12, the strips 50 stabilize the package 10.

The strips 50 in connection with the interconnecting webs of the carrier 32 act to reduce can-to-can contact, thus reducing abrasion tendencies.

Because each strip 50 fits under portions of the chimes 20 of two adjacent cans 12 in the same rank without folding such strip 50, the strips 50 stabilize the arrayed cans 12 at the openable ends 18. Moreover, portions of the sheet 40 between the slits 42, 44, of the respective pairs cover substantial portions of the openable ends 18 of the respective cans 12. Furthermore, between and around the slits 42, 44, of the respective pairs, the sheet 40 provides an expansive surface that can be imprinted with labelling or advertising.

As the sheet 40 is clipped onto the cans 12, or afterwards, the longitudinal edge portions 64, 74, can be also folded downwardly along the folding lines defined by the slits 60, 70. Folding the sheet 40 downwardly along these folding lines causes the sheet 40 to be less prone to warping.

After the package 10 has been assembled, it may be then broken away along any of the transverse rows of perforations 80, 86, 88. If the carrier 30 can be similarly divided, the package 10 comprising twenty-four cans 12 can be therefore divided into two packages, each comprising twelve cans 12, into four packages, each comprising six cans 12, or into one package comprising eighteen cans 12 and another comprising six cans 12.

In a preferred method for assembling the package 10, the cans 12 are provided in a rectangular array, on which the carrier 30 has been applied. Next, the sheet 40 is clipped onto the cans 12, in the manner specified above, such that the strips 50 are not folded. The sheet 40 may be clipped onto the cans 12 in a manual operation or in an automated operation, such as a rolling operation, in which the strips 50 are forced downwardly relative to the planar portion 52, for example by a cogged or selectively actuable roller (not shown) so as to snap beneath the chimes 20 of the adjacent cans 12. The longitudinal edge portions 64, 74, may be simultaneously or subsequently folded downwardly along the folding lines defined by the slits 60, 70.

Various modifications may be made in the package 10, in the sheet 40, or in the method described above for assembling the package 10 without departing from the scope and spirit of this invention.

We claim:

1. A generally planar sheet for stabilizing a rectangular array of substantially identical cans of a type having an openable end with a chime and for covering substantial portions of the openable ends of the cans, the sheet having multiple pairs of substantially parallel slits, the pairs being arrayed in longitudinal rows and transverse ranks, the sheet having can-stabilizing strips disposed respectively between the pairs in each rank, the strips being defined by slits of the pairs in each respective row and by slits of the pairs in each adjacent row, the sheet being configured to be clippable onto the cans in the rectangular array in such manner that portions of the chimes of the respective cans extend into the slits of the respective pairs and that each strip fits, without folding such strip, under portions of the chimes of two adjacent cans in the same rank.

2. The sheet of claim 1 wherein the slits of every pair are parallel.

3. The sheet of claim 2 wherein the slits of every pair extend longitudinally.

4. The sheet of claim 1 wherein each strip has side edges adapted to abut the adjacent cans directly beneath the chimes of the adjacent cans when the sheet is clipped onto the cans.

5. A package for merchandising substantially identical cans of a type having an openable end with a chime, the package comprising (a) a rectangular array of said cans, which are arrayed in longitudinal rows and transverse ranks in such manner that the openable ends thereof extend in a common direction, and (b) a generally planar sheet having multiple pairs of substantially parallel slits, the pairs being arrayed substantially as the cans are arranged, the sheet having can-stabilizing strips disposed respectively between the pairs of slits in each rank, the strips being defined by slits of the pairs in each respective row and by slits of the pairs in each adjacent row, the sheet being clipped onto the cans in the rectangular array in such manner that portions of the chimes of the cans extend into the paired slits of the respective pairs and that each strip fits, without folding such strip, under portions of the chimes of two adjacent cans in the same rank.

6. The package of claim 5 wherein the slits of every pair are parallel.

7. The package of claim 6 wherein the slits of every pair extend longitudinally.

8. The package of claim 5 comprising a carrier including means for gripping the cans in the rectangular array in such manner that the carrier does not interfere with the sheet.

9. The package of claim 5 wherein each strip has side edges abutting the adjacent cans directly beneath the chimes of the adjacent cans.

* * * * *